US005655336A

United States Patent [19]

Azar

[11] Patent Number: 5,655,336

[45] Date of Patent: Aug. 12, 1997

[54] TELESCOPIC LIGHT METAL FORM BOARD

[76] Inventor: Tony Azar, 1038 Lesperance Road, Tecumseh, Ontario, Canada, N8N 1W8

[21] Appl. No.: 488,635

[22] Filed: Jun. 8, 1995

[30] Foreign Application Priority Data

Sep. 16, 1994 [CA] Canada ..... 2132252

[51] Int. Cl.[6] ..... E04B 2/82

[52] U.S. Cl. ..... 52/126.1; 52/263; 52/632; 299/19; 299/23; 299/24

[58] Field of Search ..... 52/126.1, 126.5, 52/263, 632; 249/19, 23–25, 27–28

[56] References Cited

U.S. PATENT DOCUMENTS

| | | | |
|---|---|---|---|
| 3,680,711 | 8/1972 | Brucker | 52/632 X |
| 3,889,779 | 6/1975 | Kummerlin | 52/632 X |
| 4,038,710 | 8/1977 | Tambascio | 52/632 X |
| 4,248,024 | 2/1981 | Dahlstrom | 52/632 |
| 4,342,440 | 8/1982 | Eyden | 52/632 X |
| 4,348,843 | 9/1982 | Cairns et al. | 52/632 X |
| 4,357,785 | 11/1982 | Eklund | 52/632 |
| 4,397,127 | 8/1983 | Mieyal | 52/632 X |
| 4,720,016 | 1/1988 | Kay | 52/632 X |
| 4,745,724 | 5/1988 | Reetz | 52/632 |
| 5,062,245 | 11/1991 | Dent | 52/632 X |
| 5,079,884 | 1/1992 | Menchetti | 52/632 X |

*Primary Examiner*—Wynn E. Wood
*Assistant Examiner*—Beth Aubrey
*Attorney, Agent, or Firm*—Anthony J. Casella; Gerald E. Hespos

[57] ABSTRACT

A formwork board is disclosed for use in the placement of concrete slabs, sidewalks, driveways, and footings. It includes a first element and a second element. The first element is adapted to telescopically receive the second element to provide a board of variable lengths. The elements of the board are advantageously fabricated from a light metal, or a light metal alloy.

9 Claims, 3 Drawing Sheets

TELESCOPIC LIGHT METAL FORM BOARD

Figure 1:
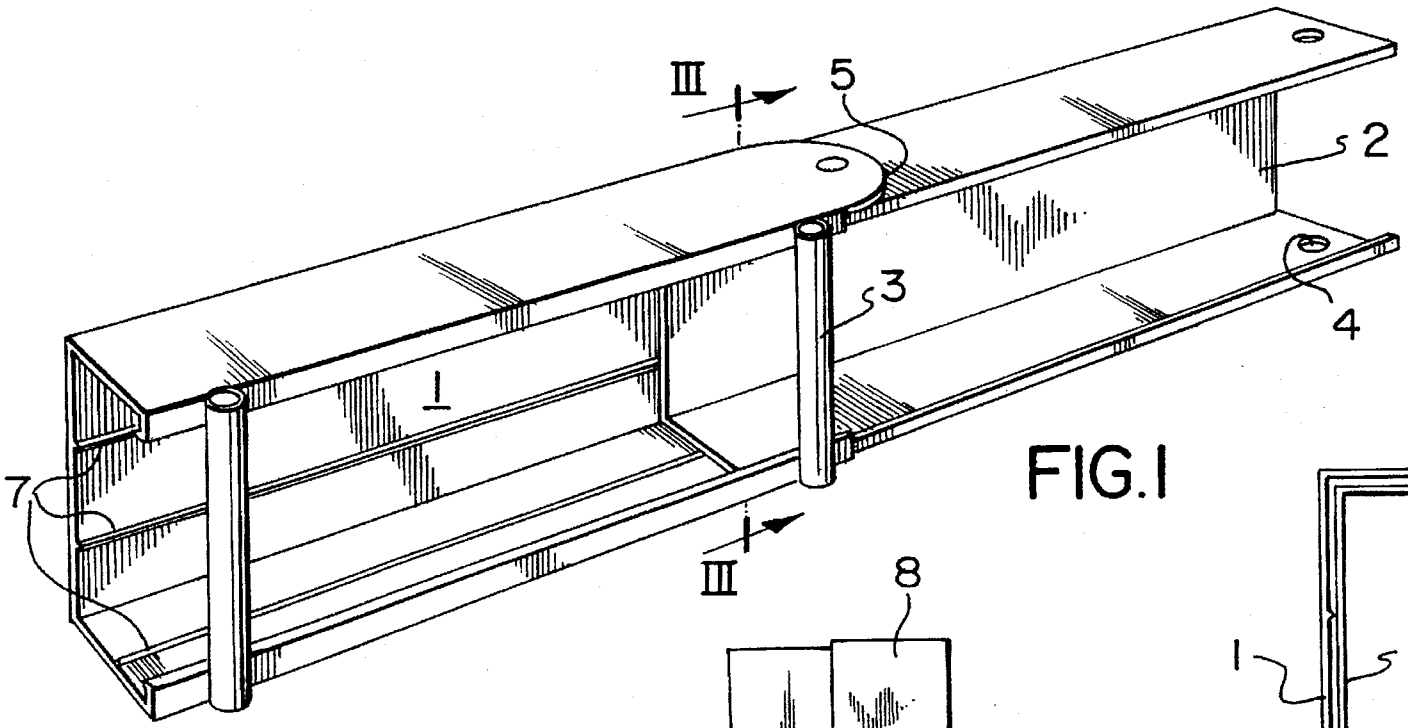

The present invention relates to the field of concrete formwork. In particular, the present invention provides a novel telescoping formwork for use in placing concrete footings for building construction.

Concrete placement for residential construction can generally be considered as being either the pouring of an on-grade slab, or the pouring of a sub-grade foundation. Slab placement is usually utilized if climactic conditions do not necessitate an insulated foundation below the usual extent of frost penetration. Preparation of a site for a slab is fairly straightforward. After levelling and isolation of service conduits a frame of low formwork is erected, and concrete is poured into the frame, which is subsequently removed after the concrete has set. The frame for slab placement is conventionally constructed from 2"×6" or 2"×8" lumber, which may have a release agent applied thereto. In order to obtain lumber of appropriate length for a given slab dimension, it is often necessary to cut lumber into shorter lengths than are desirable for most applications. It will be appreciated, therefore, that a drawback of utilizing lumber for slab formwork is that it will be more or less continually consumed by ongoing demand for appropriate lengths of lumber. Moreover, wooden formwork will wear out after continual use, and frequent exposure to concrete, which is caustic.

One solution to the drawbacks of wooden formwork proposed for slab construction is disclosed is Canadian Patent No. 1,107,532 which shows contoured sheet metal forms designed to remain integral with a slab after a pour. The sheet metal forms disclosed are conformed to withstand the lateral pressure of the concrete in the slab before it sets, and so do not present a smooth exterior surface and therefore must be covered for aesthetic reasons if the slab sides are exposed when construction is complete. Moreover, even though sheet metal is not expensive, the cost of purchasing all new formwork for each pour is prohibitive for residential builder.

Alternatively, a sub-grade foundation may be utilized in construction, especially construction of dwelling units. In such a case, the building lot is excavated to safely below maximum frost penetration and levelled. concrete footings are then poured around the footprint of the house or building, and upon these footings, foundation walls are built. The footings are constructed with the use of forming materials similar to that used in slab construction. To pour footings, however, spaced forms create a channel into which concrete is poured and permitted to set. The forms are then stripped away. Again, lumber has heretofore been the material of choice for footings forms, and there has been no use of sacrificial forms, due to the fact that the cost of such non-reusable forms would double since twice as many of same would be required to create the form for the inside and the outside form wall of the footings. Furthermore, it will be appreciated that lumber consumption for footings forms increases greatly in comparison to slab form lumber usage, since a large number of short and irregular lengths of lumber are required to construct the inner walls of footing form.

In view of the foregoing, the object of the present invention is to provide a novel forming system for use in constructing concrete slabs, footings, sidewalks and driveways. The forming system of the present invention utilizes telescoping light metal elements that are reusable, barring extra-ordinary damage, a limitless number of times, and which can be set to provide a form board of variable lengths within a fairly large range. The elements of the present invention, because of their construction from light metals, in particular aluminum or magnesium, are light in weight, and may incorporate structures facilitating the interconnection of elements.

In a board aspect, therefore, the present invention relates to a formwork board for use in the placement or concrete slabs, footings, sidewalks and driveways, including a first element and a second element, the first element being adapted to telescopically receive the second element to provide a form board of variable lengths.

Figure 3:
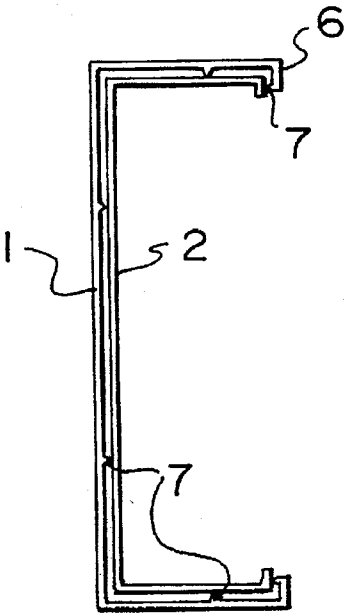
Figure 2A:
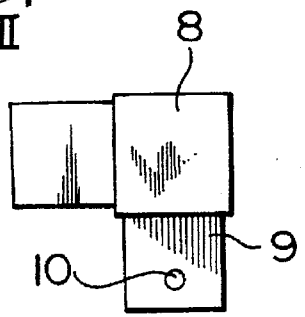
Figure 4A:
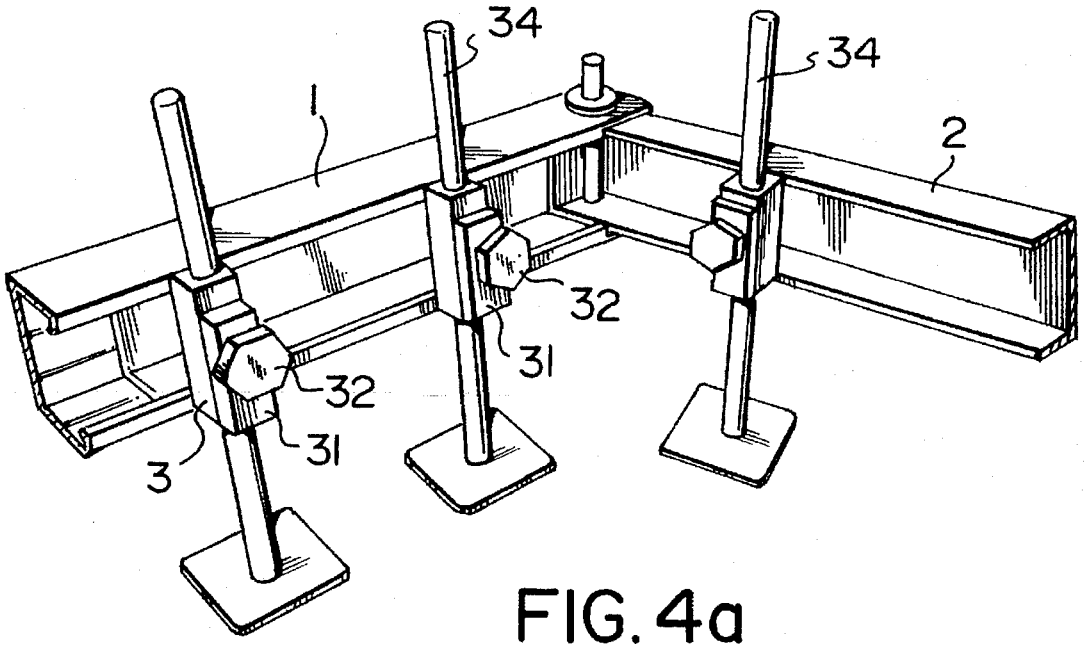
Figure 5:
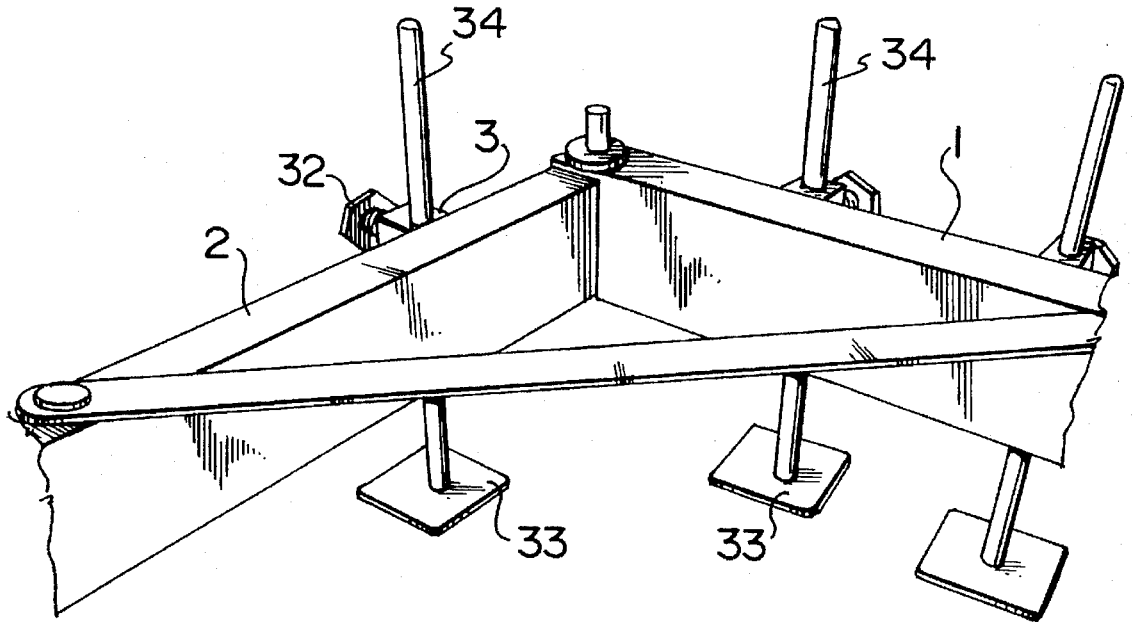
Figure 6:
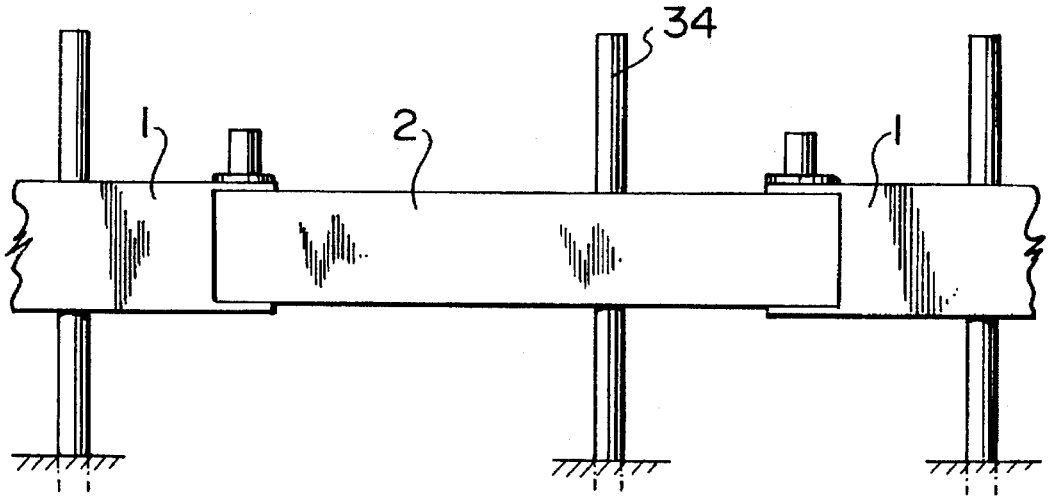

In drawings that illustrate the present invention by way of example:

FIG. 1 is a perspective view of a telescopic concrete footing or slab form board according to the present invention;

FIG 2*a* and 2 *b* are top views of corner and straight line connections of the form boards of the present invention;

FIG 3 is a cross-sectional view through line III—III of FIG. 1;

FIGS. 4*a* and 4 *b* are perspective views of a preferred embodiment of the present invention for forming an inside corner of a footing;

FIG. 5 is a perspective view of a preferred embodiment of the present invention for forming an outside corner of a footing; and FIG. 6 is a front elevational of a series of three boards, telescoped together.

Referring now to the drawings, FIG. 1 shows the telescopic form board of the present invention, comprising an outer profiled light metal element 1 typically about four feet long and an inner profiled light metal element 2 also about four feet long, telescopically received in the outer element. As can be seen of FIG. 3, each element is preferably C-shaped with a flat outwardly facing surface 11 which defines the forming surface of the board.

The ends of the upper and lower arms of the outer element 1 are provided with inwardly directed flanges 6, to retain the inner element 2 within the outer element 1 during use. It will also be observed that a series of spaced parallel ridges 7 are preferably provided on the inner surface of the outer element 1. The function of the ridges 7 is to limit the surface to surface contact between the inner 2 and outer 1 elements, so that they may be telescopically manipulated with a minimum of friction. Moreover, provisions of the ridges 7 ensures that if small amounts of concrete or cement adhere to an inner or outer element, they may still be telescoped relative to one another.

Regarding the C-shape of the inner and outer elements, it will readily be appreciated that several other shapes may effectively be utilized without departing from the spirit of the present invention. For instance, an L-shape may be used effectively, or an elongated box-shape may be used, with the inner element contained entirely within the outer element in a fully inwardly telescoped condition.

Referring again to FIG. 1, it will be observed that means 3 are provided to position and secure the form board in position. In the embodiment shown, means 3 are tubes welded at their upper and lower extremities to upper and lower flanges 6 of outer element 1, typically every four feet. After it is determined where the form board is to be positioned, it is placed in position and stakes, such as lengths of rebar, are driven through the tube means 3, to fix the board against shifting when concrete is poured against it.

At each end of each inner and outer element, apertures 4 are provided. Apertures 4 may be formed directly in the upper and lower surfaces of elements 1,2, or may be formed in longitudinally extending tabs 5. Tabs 5 may be provided at one or both ends of the outer element, for formation of inside or outside corners. That is, if an inner element is placed between a pair of tabs 5 an outer element, with a bolt means 13 passing through the aligned apertures of the inner element and tabs of the out element, and the elements are swivelled to 90° relative to one another, than an outside corner may be formed by the meeting of the inner forming surfaces 11 of the inner and outer elements, as illustrated in FIG. 5.

Figure 4B:
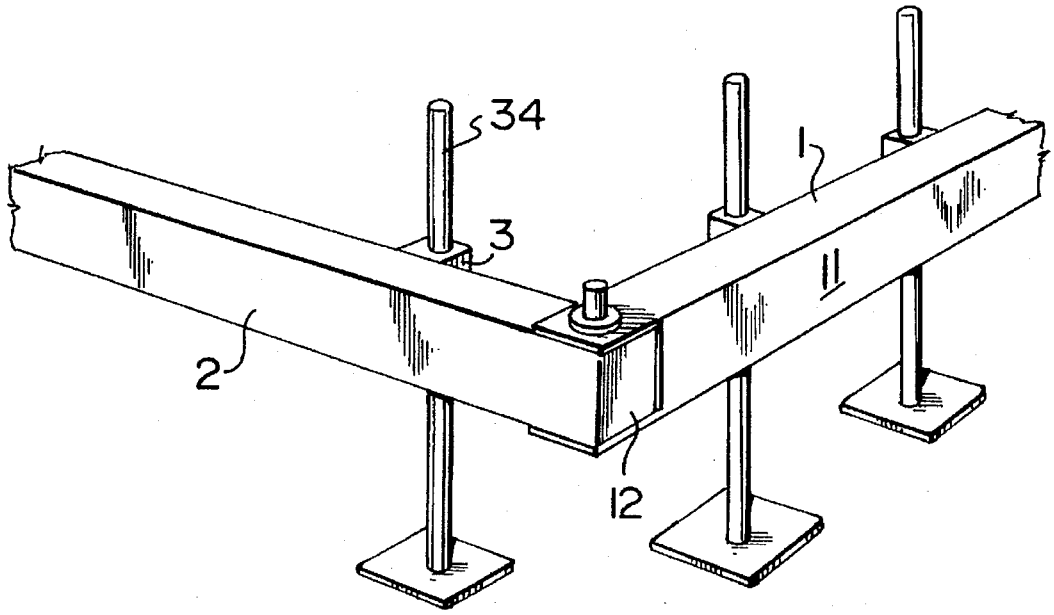

Similarly, an inside corner may be formed, as shown in FIGS. 2*a* 4*a* and 4*b*, by the placement at 90° of an inner element 2 and outer element 1, with the end plate 12 that may be provided on the inner element 2 being positioned co-planar with the forming surface 11 of the outer element 1 adjacent thereto.

FIGS 4*a*, 4*b* and 5 also illustrate a form of height adjustment that may be integrally provided with the inner and outer forming elements. In these embodiments, securement means 3 have set-screw means 31 provided integrally therewith. Set-screw means 31 include large manually adjustable set-screws 32 threadingly adjustable in threaded apertures provided in connection with tubes 3, to tighten against stakes 34, that are provided instead of rebar. Posts 34 are provided with flat bases 33 or pointed steel stakes to stabilize the form boards, and permit height adjustment and levelling thereof.

Figure 2B:
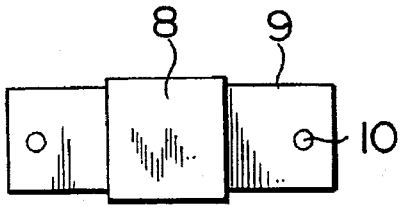

As seen in FIGS. 2*b* and 6, form boards may be joined end to end, with the inner element 2 of a board connected to outer elements 1 of two adjacent boards, to provide a continuous, long board.

Use of telescoping form boards as described herein virtually eliminates the need to cut, nail, and thereafter waste lumber in the constructing of forms for concrete footings, slabs, sidewalks, or driveways. Modular connection from one board to the next, either in straight lines or corners, ensures that connections are made quickly and cleanly, and can be made with relatively unskilled labour.

It is anticipated to fabricate the elements of the boards of the present invention by extrusion of aluminum, but it will be appreciated that other metal forming techniques may be used, and other light metal such as magnesium or other light metals or alloys, may be utilized. Furthermore, the board elements of the present invention may be fabricated in any convenient dimensions, but 2"×6" and 2"×4" will be the most commonly used.

It is to be understood that the examples described above are not meant to limit the scope of the present invention. It is expected that numerous variants will be obvious to the person skilled in the field of formwork design without any departure from the spirit of the invention. The appended claims, properly construed, form the only limitation upon the scope of the invention.

I claim:

1. A formwork board for use in the placement of concrete slabs, sidewalks, driveways, and footings, including a first substantially C-shaped element fabricated from a light metal, said first element including a form wall, a pair of support walls projecting from spaced apart locations on said form wall and a pair of flanges protecting toward one another from locations on said support walls spaced from said base wall, inwardly facing surfaces on said first C-shaped element being provided with longitudinally extending ridges, and a second C-shaped element fabricated from a light metal, the second element being slidably telescopically received on the ridges within the first C-shaped element to provide a board of variable lengths, said flanges on said first C-shaped element retaining said second element therein, said second element having spaced vertical tube elements secured thereto for receiving ground engaging means for securely anchoring said formwork board to a ground surface and against lateral shifting.

2. A formwork board as claimed in claim 1, wherein said light metal is selected from the group consisting of aluminum, magnesium, aluminum alloys and magnesium alloys.

3. A formwork board as claimed in claim 1, wherein said spaced vertical tube elements are provided with means to tighten against or graspingly engage said ground engaging means.

4. A formwork board as claimed in claim 3, wherein said ground engaging means comprise vertical rods extending upwardly from ground level.

5. A formwork board as claimed in claim 4, wherein said means to tighten against or graspingly engage said ground engaging means comprise set screws in said spaced vertical tube elements.

6. A formwork board as claimed in claim 1, wherein said first and second elements include opposed longitudinal ends, at least one end of each said first and second elements comprising means for telescopically receiving said second element in and at an angle to said first element, such that said first and second elements define a formwork board for forming a corner.

7. A formwork board for forming concrete slabs, sidewalks, driveways, and footings, including a first elongate element of substantially C-shape cross-section comprising a concrete-engaging wall having a substantially planar concrete-engaging surface for engaging said concrete, a pair of support walls projecting from a side of said concrete engaging wall opposite said concrete engaging surface and a pair of flanges projecting toward one another from said support walls, a second elongate element slidably engaged between said walls and said flanges of said first element, said second element having a substantially planar concrete-engaging surface adjacent said concrete engaging wall of said first element and extending parallel to said concrete-engaging surface of said first element a plurality of elongate tubes extending between said flanges of said first element and substantially parallel to said concrete engaging wall of said first element, said tubes being aligned substantially parallel to said concrete engaging wall and substantially transverse to the elongate first element, rods slidably engaged in said tubes for supporting engagement with a ground surface.

8. A formwork board as claimed in claim 7, wherein said first element includes longitudinally extending ridges disposed for engaging said planar concrete-engaging surface of said second element for spacing said elements from one another and facilitating relative longitudinal movement between said first and second elements.

9. A formwork board for forming concrete slabs, sidewalks, driveways and footings in proximity to a ground region, including a first elongate element and a second elongate element, the first element being configured to telescopically receive the second element therein to provide a board of variable lengths, a plurality of spaced tube elements secured to said second element and aligned to the length of said board, rods slidably received respectively in said tubes and extending therefrom for supporting engagement with the ground, and means for releasably securing said tubes to the respective rods therein.

* * * * *